United States Patent [19]

Hanson

[11] Patent Number: 4,697,970

[45] Date of Patent: Oct. 6, 1987

[54] COVER FOR BINDING SHEETS

[75] Inventor: Gary R. Hanson, Minneapolis, Minn.

[73] Assignee: Minnesota Mining and Manufacturing Company, Saint Paul, Minn.

[21] Appl. No.: 864,531

[22] Filed: May 19, 1986

[51] Int. Cl.[4] ..... B42C 11/00; B42D 3/00

[52] U.S. Cl. ..... 412/4; 281/15 R; 281/21 R; 281/29; 156/90

[58] Field of Search ..... 156/90, 227, 291, 486, 156/508, 908; 281/21 R, 29, 34, 35; 412/46, 78, 900, 901

[56] References Cited

U.S. PATENT DOCUMENTS

| | | | |
|---|---|---|---|
| 848,680 | 4/1907 | Nelson . | |
| 1,765,194 | 6/1930 | Von Auw . | |
| 1,913,969 | 6/1933 | Wood . | |
| 2,014,305 | 9/1935 | Alger . | |
| 2,455,971 | 12/1948 | Bosch | 412/27 X |
| 3,088,754 | 5/1963 | Burgmer | 282/22 |
| 3,179,967 | 4/1965 | Yohn et al. | 11/1 |
| 3,188,114 | 6/1965 | O'Brien et al. | 281/21 |
| 3,206,225 | 9/1965 | Oleson | 281/29 |
| 3,210,093 | 10/1965 | Steidinger | 281/21 |
| 3,825,963 | 7/1974 | Abildgaard et al. | 11/1 |
| 3,833,244 | 9/1974 | Heimann | 281/21 |
| 3,995,886 | 12/1976 | Staats | 156/277 X |
| 4,007,950 | 2/1977 | Giulie | 281/25 |
| 4,106,148 | 8/1978 | Axelrod | 11/1 |
| 4,129,471 | 12/1978 | Rome | 156/277 X |
| 4,213,220 | 7/1980 | Lopez-Martinez | 11/1 |
| 4,266,812 | 5/1981 | Staats | 412/900 X |
| 4,447,481 | 5/1984 | Holmberg | 428/40 |
| 4,511,298 | 4/1985 | Jones | 412/34 |
| 4,518,296 | 5/1985 | Pearson et al. | 412/37 |
| 4,558,888 | 12/1985 | Hanson et al. | 281/1 X |
| 4,562,102 | 12/1985 | Rabuse et al. | 156/90 X |
| 4,590,109 | 5/1986 | Holmberg | 428/40 |

FOREIGN PATENT DOCUMENTS

| | | | |
|---|---|---|---|
| 0110237 | 6/1984 | European Pat. Off. . | |
| 2815649 | 10/1979 | Fed. Rep. of Germany . | |
| 1382574 | 11/1964 | France | 281/21 R |
| 6711263 | 2/1969 | Netherlands | 281/21 R |

*Primary Examiner*—Paul A. Bell

*Attorney, Agent, or Firm*—Donald M. Sell; James A. Smith; John C. Barnes

[57] ABSTRACT

A cover for use in binding sheets without use of a machine comprises a sheet of cover with a central fold dividing the cover to a front cover portion and a back portion and a strip of pressure-sensitive adhesive along the fold has a moveable liner.

14 Claims, 10 Drawing Figures

COVER FOR BINDING SHEETS

BACKGROUND OF THE INVENTION

1. Field of the Invention

The present invention relates to a cover and process for the binding of a plurality of loose pages together using just a stiff strip of a binding adhesive to attach the pages together along shingled edges of the pages.

2. Description of the Prior Art

The binding cover of the present invention is adapted to replace various binding systems for a plurality of pages up to about 25 pages. Prior binding systems for a small number of pages comprised staples, loose-leaf binders, mechanical fasteners, i.e., paper clips, prongs and fasteners as sold by Acco International Inc., Chicago, Ill. 60630, paper fasteners and washers as sold by Swingline, Inc., Long Island City, N.Y. 11101, plastic rivets, pins, slide strip binders and other jackets with built-in prongs for retaining perforated sheets. Binding by the use of performed covers having a hot melt adhesive requiring a mechanism or tool for effecting the binding operation is not considered relevant. The shingling of sheets to expose a marginal portion of each sheet and binding them together by use of adhesive contacting the edge of each sheet is known in the prior art. Such binding methods are taught by U.S. Pat. Nos. 1,765,194 and 2,455,971.

The assignee of this application has several applications copending for similar binding products incorporating pressure-sensitive adhesive for use in binding sheets together, and U.S. Pat. Nos. 4,518,296; 4,558,888 and 4,562,102 directed to an apparatus for use in binding sheets together with the adjacent edges shingled.

The essential difference between the present invention and the prior art is that a cover corresponding to the present invention may be utilized to bind a plurality of sheets or papers together without the use of tools, fixtures, machines, electrical power, or lapsed time for heating or cooling the adhesive. Further, the shingling prior art states that only supple adhesive zones can be used to produce bound documents. The cover of the current invention consists of a stiff backing divided into a front and back portion with a strip of pressure-sensitive adhesive along the dividing line and a release material is provided to protect the adhesive prior to the binding operation.

The plurality of pages bound together by this binding cover reduces required storage space, allows stacking and the lay-flat feature provides for easy copying, reading, handling and page butting.

SUMMARY OF THE INVENTION

The present invention is directed to a backing for binding sheets together, which backing is formed of cover card stock creased across by a central fold score line to form a front and back portion. The cover portions have a length which is at least equal to the length of the paper to be bound plus some marginal dimension if desired, and a width corresponding to the width of the paper to be bound plus the width of the binding adhesive which is located on the back cover along one marginal longitudinal edge at the central fold score line and extending marginally across onto the front cover plus some marginal dimension if desired.

The band of binding adhesive is protected initially by a strip of a release material (such as a liner) which will allow for the easy exposure of the adhesive band as needed for binding.

BRIEF DESCRIPTION OF THE DRAWING

The present invention will be further described with reference to the accompanying drawing wherein.

DESCRIPTION OF THE PREFERRED EMBODIMENTS

Figure 1:
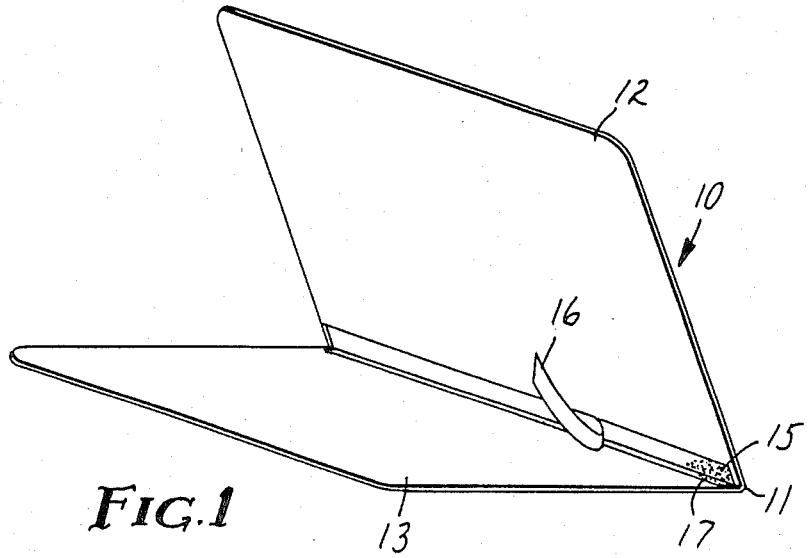
FIG. 1 is a perspective view of a cover according to the present invention.
Figure 2:
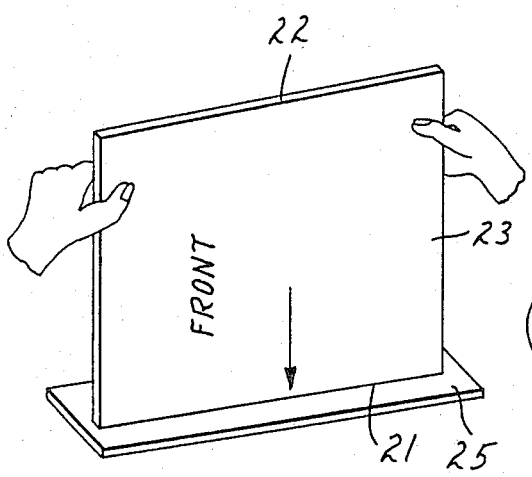
FIG. 2 is a view of a step in the binding process to align the pages to be bound.

Referring now to FIG. 1, the backing of the present invention is illustrated and comprises a sheet 10 of cover stock which may be a paper composition having a caliper of about 0.009 inch and a basis weight of 80 pounds per ream (ream size 20 inches×26 inches), which sheet has been formed with a flexible fold line 11 to form one longitudinal edge of the back portion 12 and one longitudinal edge of the front portion 13 and defining the line joining said portions of substantially the same dimensions. The sheet material along a zone adjacent the fold line 11 has a flexural rigidity of at least 0.002 inch-pounds thus providing a backing which has a stiffness sufficient to allow easy handling during the binding process and gives the bound document security in use. The central fold line must not be so stiff as not to allow easy closure of the cover, therefore, it should have a flexural rigidity of less than 0.03 inch-pounds, it may be preferred to keep the entire backing within these limits. Stiffness and flexural rigidity are determined by test No. 409 of the Useful Methods tests published by the Technical Association of the Pulp and Paper Industry (TAPPI).

A narrow band of pressure-sensitive adhesive 15 is coated over the zone along a longitudinal edge of the back portion 12 adjacent to the central fold score line 11. The adhesive extends slightly across this fold line 11 and the adhesive 15 is covered by a protective release material such as a liner 16, a strip having a coating of silicone with a release value of between 10 and 25 grams per inch. The adhesive is a very tacky pressure-sensitive adhesive which is in contact with the shingled edges of the sheets to be bound therein. Stress can occur during the final stages of the binding process which will cause the shingled edges to move, therefore, the adhesive must have good quick stick qualities, to allow the pages to stay attached after the initial adhesive contact, with minimal pressure and dwell time. In actual use adhesives with quick stick values less than 8 ounces per $\frac{1}{2}$ inch do not work satisfactorily, and values greater than 12 ounces per $\frac{1}{2}$ inch are preferred. Final adhesion of the bound document must be high enough that normal handling cannot cause pages to detach. Proper binding conditions are determined by using a 180° shear test and a 45° peel test described below. Acceptable values have been determined to be:

180° Shear = at least 400 grams/inch, with at least 600 grams/inch being preferred using 20 pound Bond paper and shingled 0.015 inch.

45° Peel = at last 40 grams, with at least 70 grams being preferred.

A suitable adhesive for use with this binder is a normally tacky pressure-sensitive iso-octyl acrylate/acrylic acid copolymer in a 95.5:4.5 ratio. This pressure-sensitive adhesive has good initial adhesion which can be measured by the "Quick Stick" test 5 of the PSTC (Pressure Sensitive Tape Council).

Figure 10:
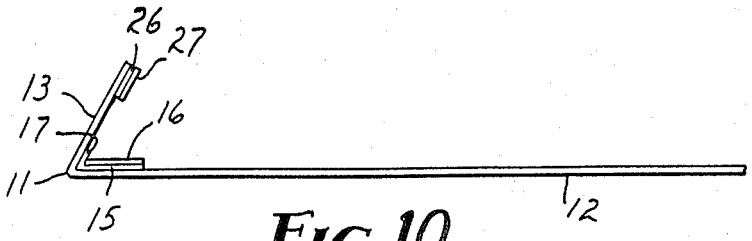
FIG. 10 is an enlarged end elevational view of a second embodiment of the cover.

The dimensions of the back portion 12 and front portion 13 of the backing are dependent on the length of the paper to be bound and the length is at least equal to the length of the paper to be bound but may be provided with an additional marginal dimension of, for example, 0.25 inch. The width of the back portion corresponds to the width of the loose pages to be bound plus the width of the binding adhesive but may be provided with an additional marginal dimension of, for example, 0.25 inch. The front portion is illustrated as having a dimension equal to the dimensions of the back portion although the front portion could be narrower for a flap to which a transparent film or other cover stock could be joined to form the booklet cover. As shown in FIG. 10 the cover portion 16 is a flap with a band of adhesive 26 and a removable liner 27 positioned along the edge opposite the front liner 16. The minimum width of the binding adhesive is determined by the maximum number of pages plus one to be bound in the cover times the paper thickness times Pi ($\pi$). Wider adhesive widths result in more adhesive overlap on the back page. An additional or extended portion 17' of the binding adhesive 15' may extend across the fold line onto the front cover which extended adhesive has a width of about Pi ($\pi$) times the paper thickness. The removable liner 16' is applied onto the adhesive 15' and may have a low adhesion coating on both sides to also contact the small band of additional adhesive 17'.

The covers are preferably made for use in bindings containing a maximum of 25 sheets of paper 23. The dimensions of the cover portions is determined as outlined below where L = length, W = width, t = thickness:

| | | |
|---|---|---|
| $L_{cover}$ | = | $L_{pages}$ + (margins × 2) |
| $L_{pages}$ | = | length of the pages |
| $W_{cover}$ | = | $W_{pages} + W_{adhesive}$ + margin |
| $W_{pages}$ | = | width of the pages |
| $W_{adhesive}$ | = | width of adhesive strip |
| | = | $\pi (N_{max} + 1)\, t_{page}$ |
| $t_{page}$ | = | thickness of the pages |
| $N_{max}$ | = | maximum number of pages the binding can handle |
| $L_{adhesive}$ | = | $L_{pages}$ |
| $W_{extend\ adh.}$ | = | $\pi\, t_{page}$ |

EXAMPLE 1

For binding 25 standard 0.005 inch 8.5 inches × 11 inches pages (US); the cover dimensions are as follows:

Cover length = at least 11 inches, preferred being 11.5 inches (with edge margins).

Cover Width (folded) $_{minimum}$ = at least 8.91 inches, preferred being at least 9.16 inches (with edge margin).

Adhesive length = 11 inches.

Adhesive Width $_{minimum}$ = at least 0.41 inch.

Width of Extended Adhesive 17 = at least 0.016 inch.

EXAMPLE 2

For binding 25 standard A-4, 0.127 mm thick by 21 cm × 29.5 cm size pages (OUS); the cover dimensions are as follows:

Cover length = at least 29.5 cm preferred being 30.77 cm (with edge margins).

Cover width (folded) $_{minimum}$ = at least 22.04 cm, preferred being at least 22.675 cm (with edge margin).

Adhesive length = 29.5 cm

Adhesive width $_{minimum}$ = at least 1.04 cm

Width of Extended Adhesive 17 = at least 0.04 cm

Figure 3:
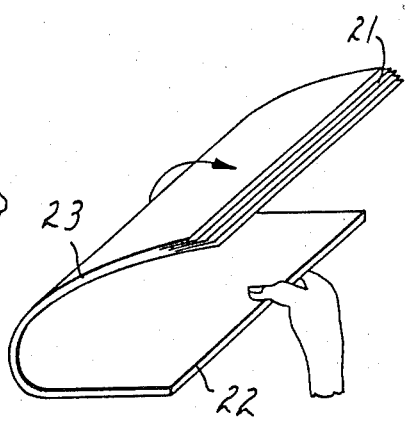
FIG. 3 is a view of a step in the binding process to shingle the edges of the pages to be bound.

In binding a plurality of loose sheets 23 the same are bound by placing the loose pages in a stack, and removing the release liner 16 from the binding adhesive strip 15, standing up the loose pages and jogging them against a flat surface 25 along a longitudinal edge 21 (front left edge). The longitudinal edge 22 opposite the jogged edge is then clamped by the fingers (or an optional paper clamp) then the pages are rolled or folded back upon themselves, as illustrated in FIG. 3, causing the unclamped longitudinal edge 21 to become shingled, exposing a margin of each sheet.

The amount of shingling (S) is equal to:

$$S = \frac{2\pi t\, N_{max.}\, x^\circ}{360^\circ}$$

where:

t = the page thickness $N_{max}$ = the maximum number of pages x° = the degree of wrap placed in the pages in performing the steps illustrated in FIG. 3, for this method x° is approximately 180°

Figure 4:
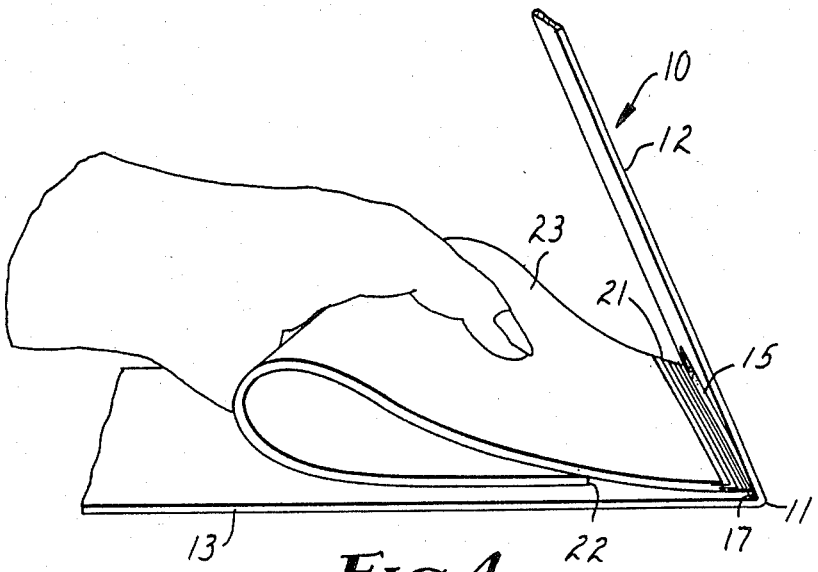
FIG. 4 is a perspective view illustrating the binding process.
Figure 5:
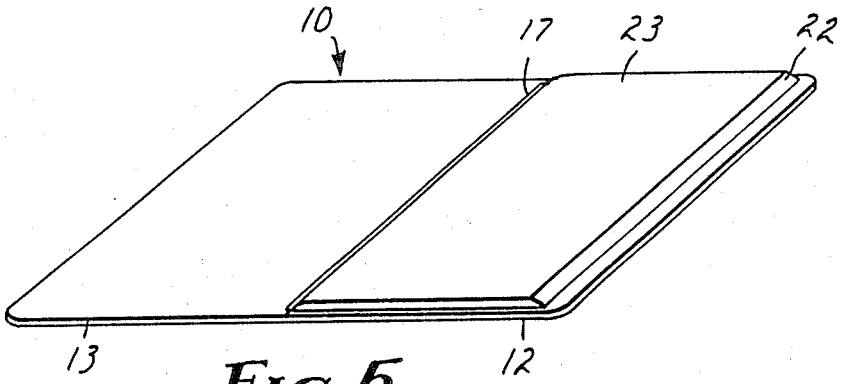
FIG. 5 is a perspective view showing a bound document.

The folded pages are then slid along the inside of the front cover portion to the central fold score line 11, as illustrated in FIG. 4, and the back cover portion is then closed so that the binding adhesive is pressed into contact with the shingled edges of the sheets. After the adhesive has been pressed into the shingled pages the folded sheets are released and allowed to lay straight. The cover portion 13 is then opened to the first page and the shingled pages 23 are again pressed into the adhesive, taking care to run a finger along the page edges, as illustrated in FIG. 5.

A document can be tested to determine whether the adhesive used provided an adequate binding for the sheets. The following test was established to assess the peel strength of a page to the binding adhesive when removed at a 45° angle.

Figure 6:
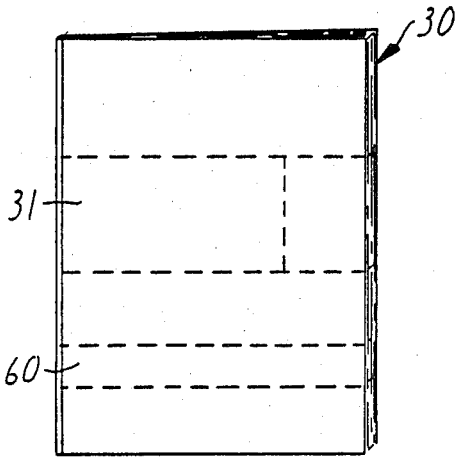
FIG. 6 is a perspective view of a bound document to be prepared for testing.
Figure 7:
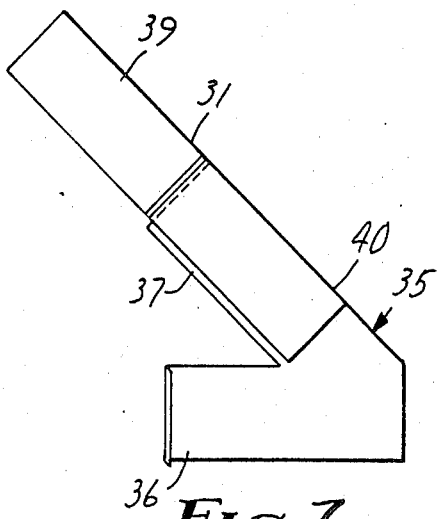
FIG. 7 is an elevational view of a test fixture.
Figure 8:
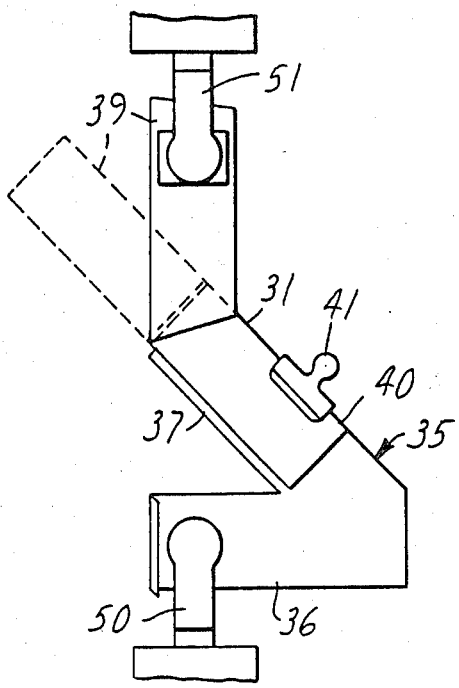
FIG. 8 is a fragmentary diagrammatical view of a test device, fixture and sample.

Referring to FIGS. 6, 7, and 8 the test is conducted as follows:

Using a paper cutter or guillotine the document or booklet 30 illustrated in FIG. 6 is first cut to provide a section 31 of the booklet 3 to 4 inches wide at the bound edge and 6 inches long. This cut section is then placed on a fixture 35 illustrated in FIG. 7, which fixture comprises a horizontally disposed portion 36 and an angled portion 37 disposed at 45° to the horizontally disposed portion 36. The document sample 31 is opened to expose the third sheet 39 and the remaining pages and the sheet 39 are then clamped along the upper marginal edge 40 of the angled portion by a clamp 41. The horizontal portion is then placed in the lower jaw 50 of an Instron tensile tester, made by Instron Corp. of Canton, Mass., and the free end of the third sheet 39 is clamped in the upper jaw 51 of the Instron tensile tester. The Instron equipment is then calibrated to provide a crosshead speed of ten (10) inches per minute, the chart length is set for ten (10) inches per minute, the gauge length is set to ten (10) inches, and the operator should use the the Gram Cell at 1000 grams full scale. Jaw separation is then initiated as shown in FIG. 8 and the test results from the chart are recorded. Similar tests can be conducted with the sixth, ninth sheet, etc.

An acceptable average value for this peel test of a booklet would be at least 40 grams with at least 70 grams and above being preferred.

Figure 9:
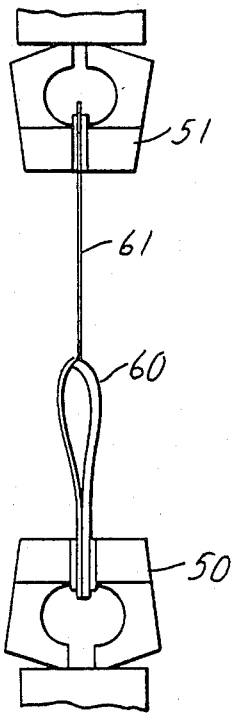
FIG. 9 is a fragmentary diagrammatical view of a test device and sample.

Another test method is a 180° shear test to establish whether the adhesive has sufficient shear strength to a document page. This test is done on an Instron tensile tester, see FIG. 9, after preparation of a booklet sample as illustrated in FIG. 6 wherein a one (1) inch wide sample 60 is cut from the finished booklet. Placing the top front page of the sample toward the operator, the operator positions the third sheet 61 from the sample 60 in the top jaw 51 of the Instron tensile tester and all of the remaining pages in the bottom jaw 50. Then calibrate the test equipment with a crosshead speed of 5 inches per minute, chart speed at 10 inches per minute, gauge length at 5 inches and use the Gram Cell at 1000 grams full scale. Then initiate jaw separation and record the force to break the bond. This test can be repeated for the sixth, ninth or twelfth sheet, etc. Acceptable values using this test are 400 grams per inch but values of 600 grams per inch and above are preferred.

It is to be understood that the strip of adhesive can be formed on the backing by coating a series of strips of adhesive to the desired width along the fold line, by applying a continuous strip of adhesive, or by applying an adhesive which has been previously coated onto a release liner and is then applied as a tape to the cover. In any event, spots, strips, or a continuous strip over an area adjacent the fold line, preferably on both sides thereof, are considered to constitute a band of adhesive.

Having thus described the present invention with reference to a preferred embodiment and modifications thereof, it is to be realized that further modifications may be made without departing from the invention as defined in the appended claims.

I claim:

1. A method of binding loose pages of paper of known length, width and thickness comprising the steps of selecting a cover having a size corresponding to the size of the papers to be bound, and a strip of pressure-sensitive adhesive on the back portion of the cover and positioned along a fold score line defining an edge of said back portion, removing a release liner from the adhesive strip, jogging the loose pages to be bound against a flat surface along the front left longitudinal edge, clamping the pages together along the opposite longitudinal edge, rolling the sheets upon themselves, causing the unclamped longitudinal edge to become shingled, placing the pages inside of the cover up to the fold score line, and pressing the adhesive strip into contact with the shingled edges of the folded pages.

2. The method of binding loose pages according to claim 1 wherein the width of said strip of pressure-sensitive adhesive is determined by the formula:

$$t\pi(N_{max}+1)$$

wherein:

t = thickness of pages $N_{max}$ = the maximum number of pages $\pi$ = Pi.

3. A cover for binding loose sheets of known length, width and thickness, said cover comprising a folded flexible sheet of cover stock having a front portion and a back portion separated by a fold line, said back portion having a length not less the length of the sheets to be bound therein, and a width not less than the width of the sheets to be bound plus an amount equal to the width of a longitudinal band of pressure-sensitive adhesive adhered adjacent to said central fold line on said back portion, said width of the band of adhesive being set by a formula as follows:

$$t\pi(N_{max}+1)$$

wherein:

t = thickness of pages $N_{max}$ = the maximum number of pages $\pi$ = Pi and said band of adhesive being in contact with a low adhesion release material.

4. A cover according to claim 1 comprising a cover stock having a flexural rigidity of at least 0.002 inch-pounds.

5. A cover according to claim 4 comprising a paper cover stock having a caliper of about 0.009 inch and a 20×26 inches ream weight of 80 pounds.

6. A cover according to claim 1 with the width greater than the width of the pages and said band of adhesive to include an additional width for marginal edges.

7. A cover according to claim 1 wherein the adhesive strip extends across the central fold score line onto the front portion.

8. A cover according to claim 1 wherein said front portion has a length and width equal to said back portion.

9. A cover according to claim 1 wherein said front portion is narrow to form a flap which has a strip of a pressure-sensitive adhesive along the free edge of the flap for the attachment of a separate cover sheet, the flap has a width corresponding to the width of the band of binding adhesive plus an additional margin plus the width of said strip of adhesive for the attachment of a separate cover.

10. A cover according to claim 1 wherein said band of adhesive has a minimum adhesion value of:

Quick Stick = 8 ounces per ½ inch, with a preferred value of 12 ounces per ½ inch; 180° shear = 400 grams to 600 grams per inch; 45° peel = 40 grams to 70 grams.

11. A cover according to claim 10 wherein said pressure-sensitive adhesive is a normally tacky pressure-sensitive iso-octyl acrylate/acrylic acid copolymer in a ratio of about 95:5.

12. A cover according to claim 1 wherein a portion of the band of binding adhesive extends across the fold line, said portion having a minimum width of Pi times a page thickness, and wherein a double coated release liner is positioned at the fold line in contact with the band of adhesive and the extended adhesive portion is in contact with the backside of the liner.

13. A cover according to claim 1 wherein said release material is a silicone coating with a release value between 10 and 25 grams per inch.

14. A cover according to claim 1 wherein the fold line has a flexural rigidity of less than 0.03 inch-pounds.

* * * * *